US007740327B2

(12) United States Patent
Hsieh

(10) Patent No.: US 7,740,327 B2
(45) Date of Patent: Jun. 22, 2010

(54) DRAWER BUFFER AND DRAWER SLIDE RAIL WITH DRAWER BUFFER

(75) Inventor: Yin-Wang Hsieh, Rm 6A Buld 13, Hongyuan, Jiangnanshijia, Jinfeng Rd, Nancheng District, Guangdong (CN)

(73) Assignees: Yin-Wang Hsieh, Nancheng District Dongguan, Guangdong (CN); Ya-Hsin Pan, Gaoxiong County (TW)

( * ) Notice: Subject to any disclaimer, the term of this patent is extended or adjusted under 35 U.S.C. 154(b) by 487 days.

(21) Appl. No.: 11/837,767

(22) Filed: Aug. 13, 2007

(65) Prior Publication Data

US 2008/0150408 A1 Jun. 26, 2008

(30) Foreign Application Priority Data

Dec. 25, 2006 (CN) ..... 2006 2 0155144 U

(51) Int. Cl.
*A47B 88/04* (2006.01)

(52) U.S. Cl. ..... 312/333; 312/319.1

(58) Field of Classification Search ..... 312/294, 312/330.1, 333, 334.1, 334.7, 334.8, 349, 312/350, 319.1; 384/21, 22; 16/49, 66, 84
See application file for complete search history.

(56) References Cited

U.S. PATENT DOCUMENTS

| | | | | |
|---|---|---|---|---|
| 6,736,471 | B2 * | 5/2004 | Lin | 312/333 |
| 7,244,005 | B1 * | 7/2007 | Lu | 312/333 |
| 2002/0011766 | A1 * | 1/2002 | Kim et al. | 312/319.1 |
| 2004/0021406 | A1 * | 2/2004 | Salice | 312/334.14 |
| 2005/0104492 | A1 * | 5/2005 | Chiu | 312/333 |
| 2006/0279186 | A1 * | 12/2006 | Lam et al. | 312/319.1 |

* cited by examiner

*Primary Examiner*—James O Hansen
(74) *Attorney, Agent, or Firm*—Global IP Services; Tianhua Gu

(57) ABSTRACT

A drawer Buffer includes: the base, cylinder and plate with the guide rod projected in the front end; the cylinder of which is fixed in the base and there is a projecting column on the front end of its piston rod; in the middle of the guide rod, there is a sliding chute for the move of piston rod; in the outer side of the guide rod, there is a guideway to coordinate with the projecting column, the front end of the guideway is linked with a positioning slot; on the plate, there is the guiding slot for traction and pushing the projecting column into the positioning slot; the section shape of the mentioned cylinder sleeve and piston rod of the cylinder is similar to the ellipse, the tail of the cylinder sleeve is linked with the head of piston rod via the spring. The buffer can be used with a drawer slide rail for drawer moving reposefully.

9 Claims, 8 Drawing Sheets

DRAWER BUFFER AND DRAWER SLIDE RAIL WITH DRAWER BUFFER

CROSS REFERENCE TO RELATED PATENT APPLICATION

This application claims the priority of the Chinese patent application No. 200620155144.5, which has a filing date of Dec. 25, 2006.

FIELD OF THE INVENTION

This new invention relates a type of drawer buffer and a type of drawer slide rail with drawer buffer.

BACKGROUND OF THE INVENTION

The drawer is a common component of furniture, it is installed in the drawer cavity by the slide rail on furniture; ordinary drawers are easy to slide out because of the vibration, and the goods in them will be dropped out; in addition, the drawer tends to make loud noises when being closed, and affects the feeling of the user and people around it. To solve this problem, various types of drawer buffers were developed by the personnel in the industry; among others, there is one type of drawer buffer consisting of the base, cylinder and plate with projected guide rod on the front end; the cylinder is fixed in the base and the base is fixed on the outer wall of the drawer by screws which enables it to move with the drawer during opening and closing; the plate is set on the inner wall of the drawer cavity which, because of the damping action of the cylinder, makes the drawer hard to slide out completely when being vibrated; the loud noises is also prevented because the damping action prevented the cylinder from colliding with the back wall with a rush. The drawer buffer can either be fitted into the drawer by consumer themselves, or fixed on the drawer slide rail in advance and sold to consumers together with the slide rail by the manufacturer for the consumers' convenience.

At present, the section shape of cylinder sleeve and piston rod of buffers used for drawer buffers and drawer slide rails with drawer buffer in the market are all round; the air capacity of the cylinder sleeve is small, the buffering power is insufficient and the stroke of the piston rod is limited; furthermore, the cylinder of them consists of only one part of cylinder sleeve and one part of piston rod, and the stroke of the piston rod is relatively small; the applicability of the product is not satisfying in practical use because the limited stroke of the piston (less than 60 mm).

SUMMARY OF THE INVENTION

The objective of this invention is to provide a type of drawer buffer and drawer slide rail with drawer buffer with larger buffer stroke, buffering power and more buffer distance in view of the shortage of the present technology.

Drawer Buffer includes: the base, cylinder and plate with the guide rod projected in the front end; the cylinder of which is fixed in the base and there is a projecting column on the front end of its piston rod; in the middle of the guide rod, there is a sliding chute for the move of piston rod; in the outer side of the guide rod, there is a guideway coordinating with the projecting column, the front end of the guideway is linked with a positioning slot; on the plate, there is the guiding slot for traction and pushing the projecting column into the positioning slot; its characteristics are: the section shape of the mentioned cylinder sleeve and piston rod of the cylinder is similar to the ellipse, the tail of the cylinder sleeve is linked with the head of piston rod via the spring.

The drawer slide rail with the drawer buffer constitutes of the outer slide plate, intermediate slide plate, inner slide plate and drawer buffer; among others, there are rolling ball races on both the upside and downside of the intermediate slide plate; the drawer buffer is fixed on the outer side of the outer slide plate, and it includes: the base, cylinder and plate with the guide rod projected in the front end; the cylinder of which is fixed in the base and there is a projecting column on the front end of its piston rod; in the middle of the guide rod, there is a sliding chute for the move of piston rod of the cylinder; in the outer side of the guide rod, there is a guideway coordinating with the projecting column, the front end of the guideway is linked with a positioning slot; the plate is connected with the inner slide plate; on the plate, there is the guiding slot for traction and pushing the projecting column into the positioning slots; its characteristics are: the section shape of the mentioned cylinder sleeve and piston rod of the cylinder is similar to the ellipse, the tail of the cylinder sleeve is linked with the head of piston rod via the spring.

The benefits of this invention are: because the section of the cylinder sleeve and piston rod is similar to the ellipse, the air capacity of the cylinder can be raised, the buffering power increased and the stroke of piston rod expanded; in addition, the piston rod of this invention has more than two parts that greatly increases the buffering stroke (at least 60 mm), and thus makes the drawer harder to slide out by vibration and harder to make loud noises to affect the feeling of the user the people around it.

BRIEF DESCRIPTION OF THE DRAWINGS

Attached Diagram 1: Structure scheme of the cylinder used in this invention of drawer buffer;

Attached Diagram 2: General cutaway view of the cylinder demonstrated in the Attached Diagram 1;

Figure 1:
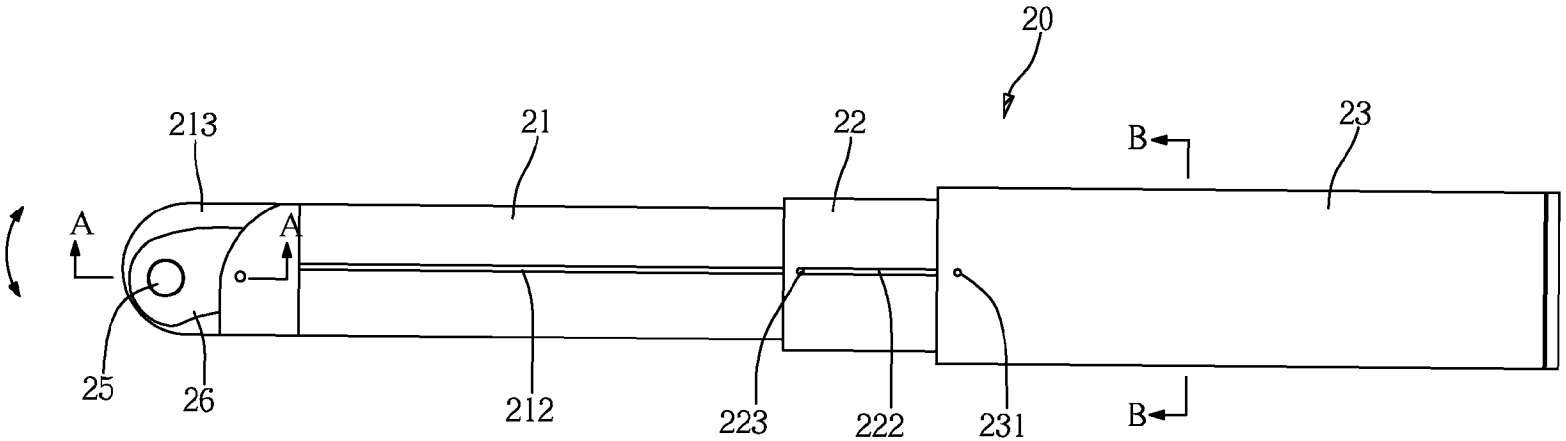
Figure 2:
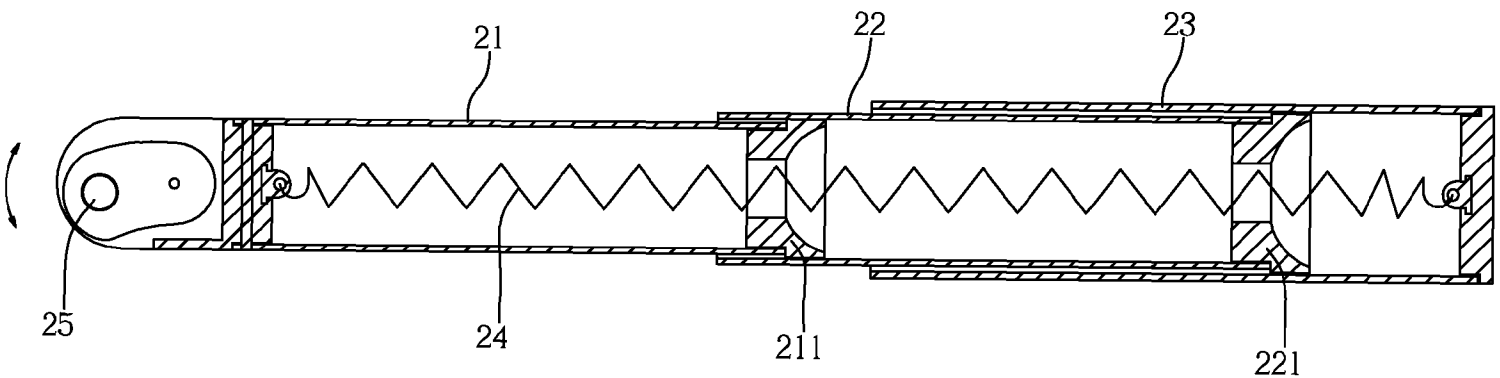
Figure 4:
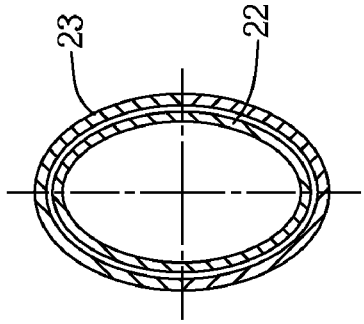
Figure 3:
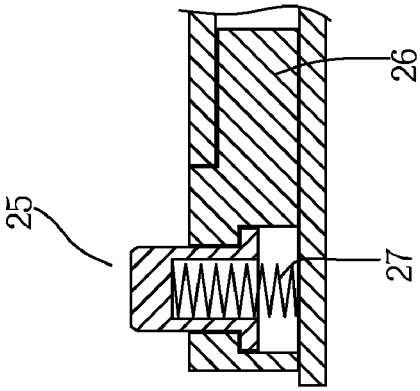
Figure 5:
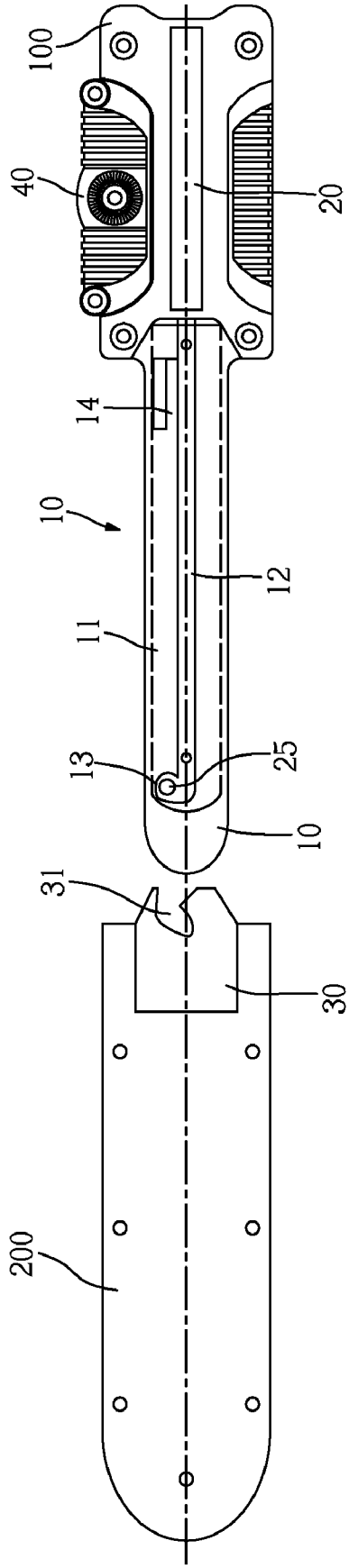
Figure 6:
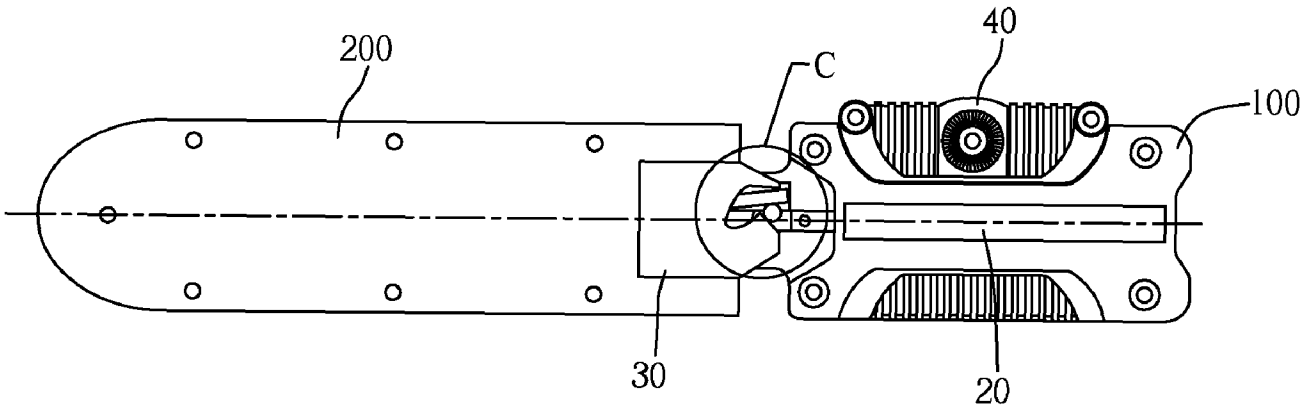
Figure 7:
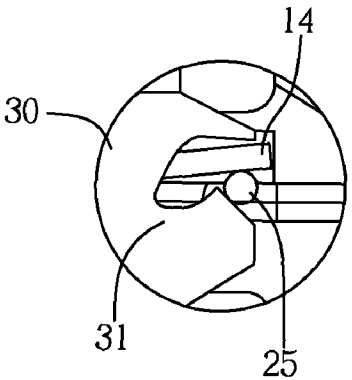
Figure 8:
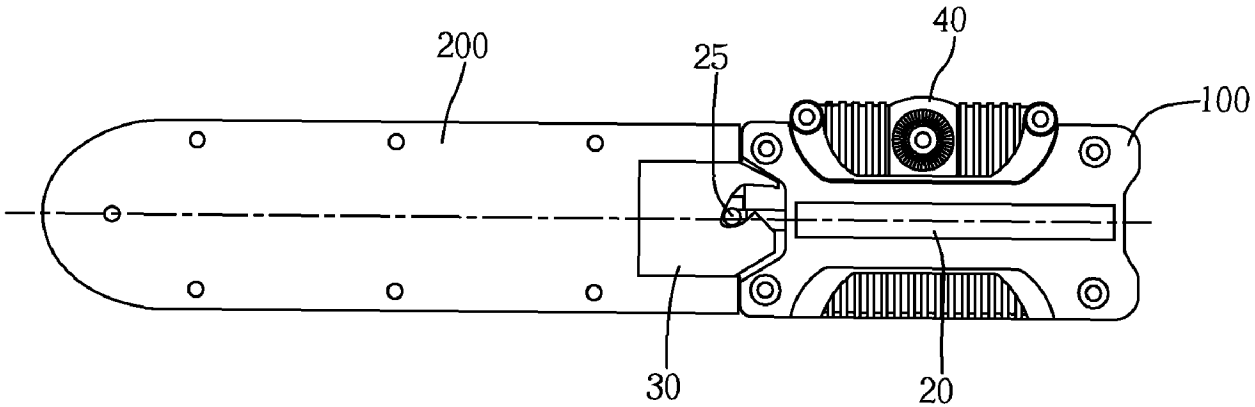
Figure 9:
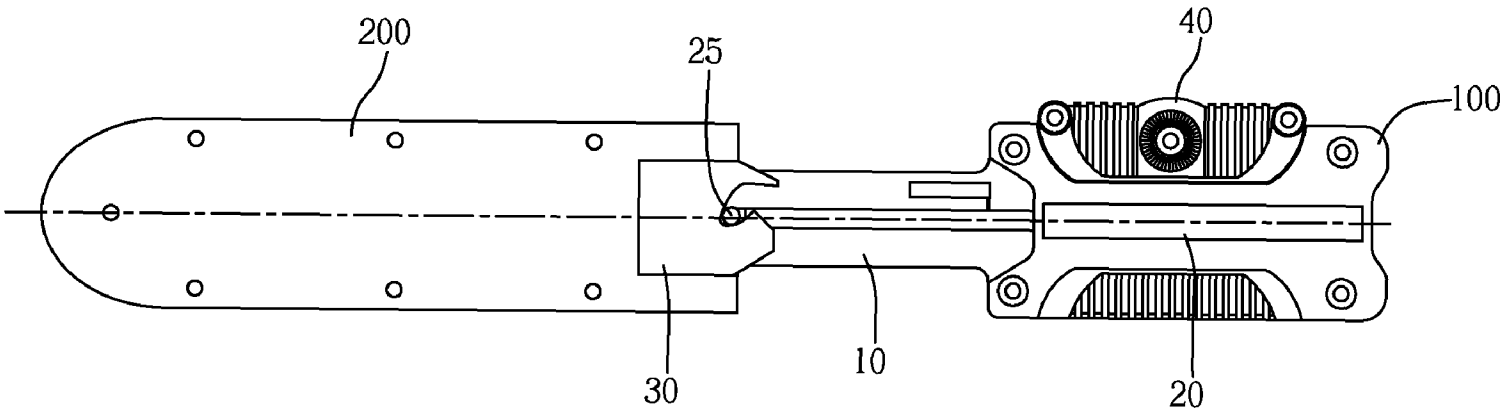
Figure 10:
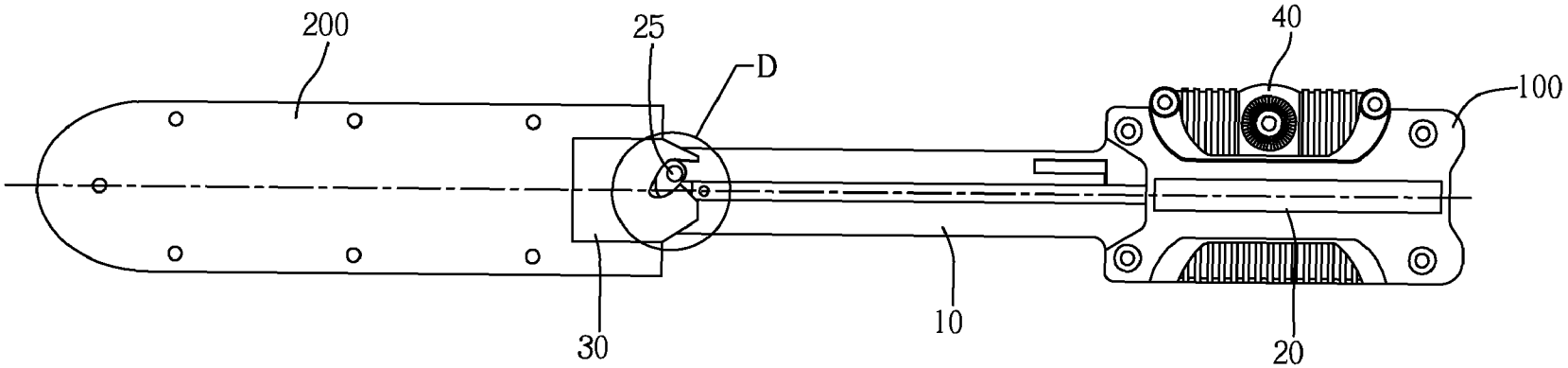
Figure 11:
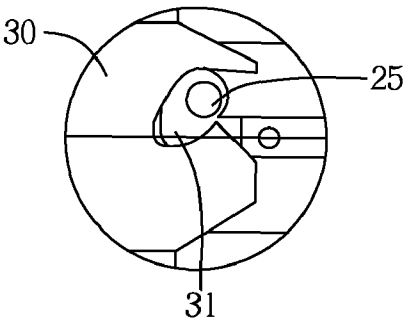
Figure 12:
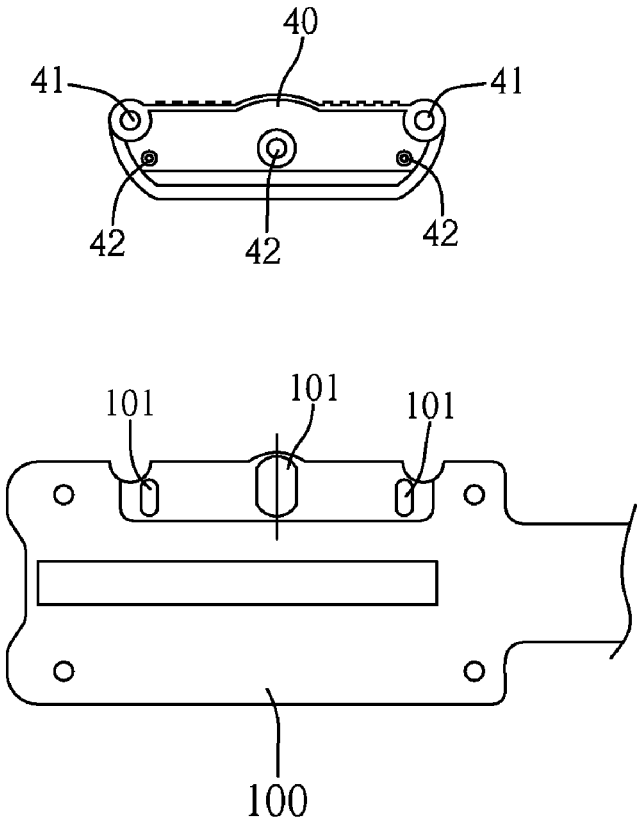
Figure 13:
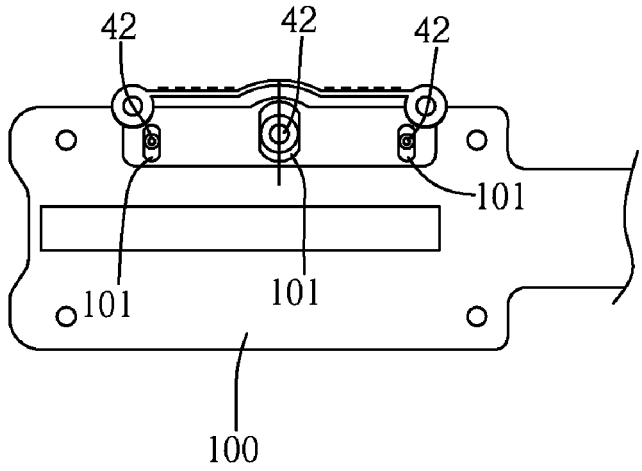
Figure 14:
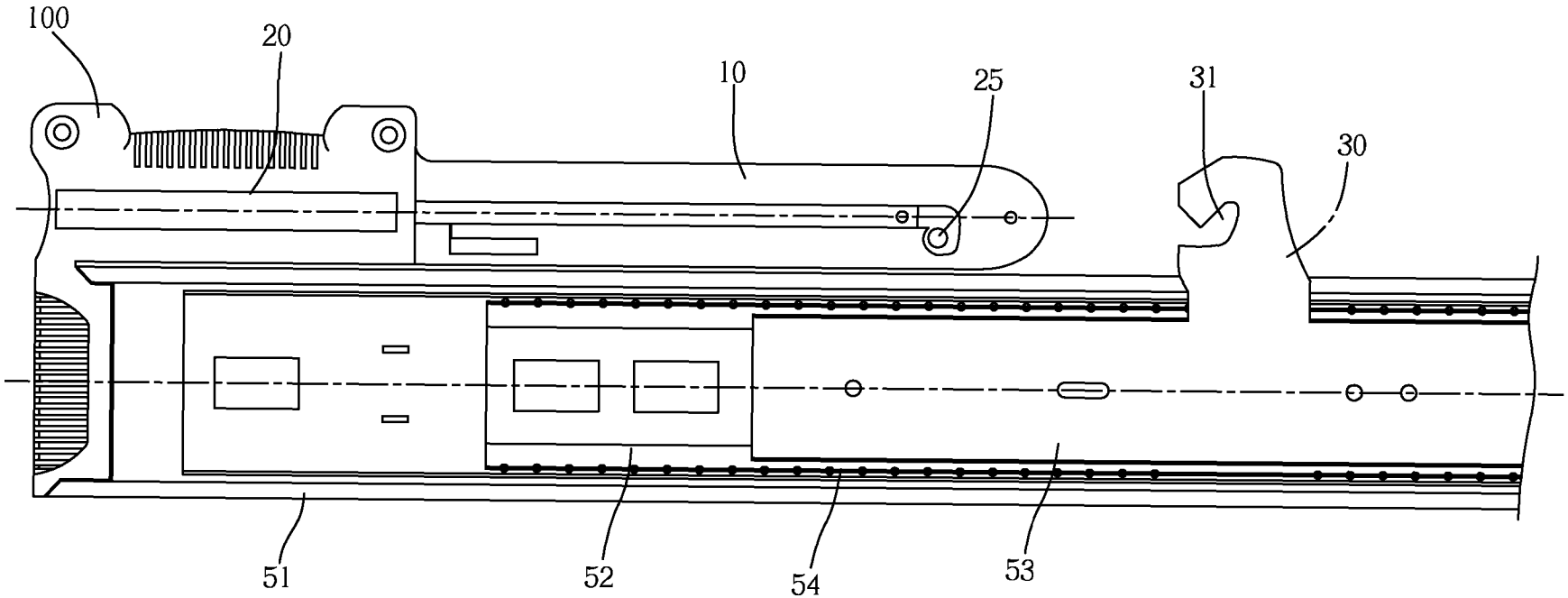
Figure 15:
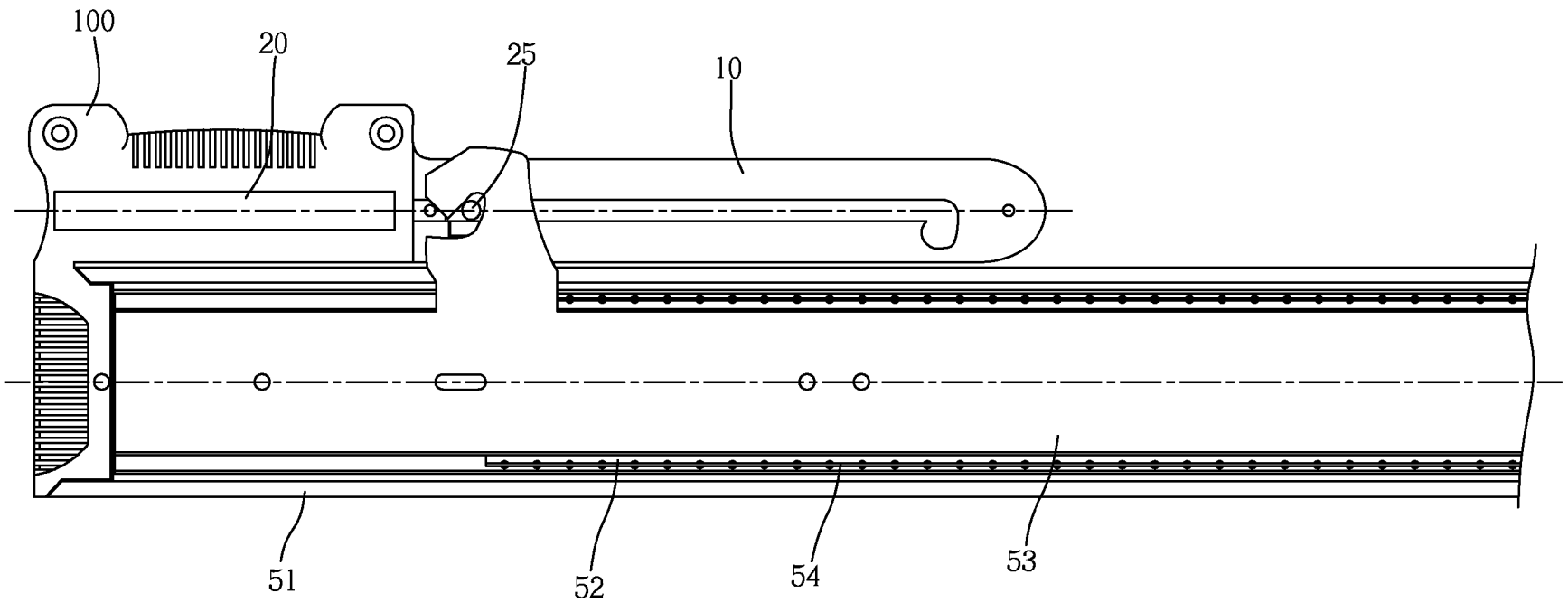

Attached Diagram 3: A-A trending partial-cutaway view of the Attached Diagram 1;

Attached Diagram 4: B-B trending section diagram of the Attached Diagram 1;

Attached Diagram 5: Structure scheme of this invention of drawer buffer;

Attached Diagram 6: Operating condition diagram I of this invention of drawer buffer;

Attached Diagram 7: Partial enlarged diagram of Position C in the Attached Diagram 6;

Attached Diagram 8: Operating condition diagram II of this invention of drawer buffer;

Attached Diagram 9: Operating condition diagram III of this invention of drawer buffer;

Attached Diagram 10: Operating condition diagram IV of this invention of drawer buffer;

Attached Diagram 11: Partial enlarged diagram of Position D in the Attached Diagram 10;

Attached Diagram 12: Decomposition diagram of the drawer buffer base and trimming bar (back cover removed):

Attached Diagram 13: Constitutional diagram of the drawer buffer base and trimming bar (back cover removed):

Attached Diagram 14: Operating condition diagram I of drawer slide rail works with drawer buffer;

Attached Diagram 15: Operating condition diagram II of drawer slide rail works with drawer buffer.

DETAILED DESCRIPTION OF THE INVENTION

The following is just one good example of the implementation of this invention, it, therefore, does not limit the protection scope of this invention.

First of all, please refer to the Attached Diagrams 1 to 5: this invention of drawer buffer includes: base 100, cylinder 20 and plate 30 (plate 30 can be installed in the front end of a sliding sleeve 200 used for containing guide rod 10) with the guide rod 10 projected in the front end; cylinder 20 is fixed in base 100, one, two or more parts of the piston rod can be used in accordance with requirements. This example of implementation takes the condition that the piston has two parts to elaborate its principle; the diagram shows that there are piston rings 211 and 221 with holes in the middle in the tail of first part piston rod 21 and the second part piston rod 22 respectively; the material of piston rings 211 and 221 should be plastics to improve the sealing performance of the cylinder and increase the buffering power; piston rods 21 and 22 are sleeve jointed with each other and the tail of cylinder sleeve 23 of cylinder 20 is linked with the head of first part piston rod 21 via built-in spring 24 passing through every piston rod in the middle. In addition, the section shape of the two piston rods 21, 22 and cylinder sleeve 23 of the cylinder is similar to an ellipse with its lengthwise strength larger than lateral length so as to increase the air capacity of cylinder and enhance the buffering power.

There is a sliding chute 11 for the move of the piston rod of cylinder 20 in the middle of the guide rod 10, and a guideway 12 on the outer side of the guide rod 10; the front end of the guideway 12 is linked with a positioning slot 13; there a guiding slot 31 on the plate 30.

There is a projecting column 25 on the front end of the first part piston rod 21; the projecting column 25 is fixed on the moving block 26 and there is a spring 27 under it to enable the projecting column 25 to expand; after the buffer is installed on the drawer, even if the gap between the plate 30 and the guide rod 10 is relatively large, the projecting column 25 can still go into the guiding slot 31 on the plate 30. The moving block 26 is hinged with the base 213 on the front end of piston rod 21 so that the moving block 26 can be rotated together with the projecting column 25, and thus makes it convenient for the projecting column to be inserted into the positioning slot 13 or the guiding slot 31.

There are restrict slots 212 and 222 on the outer side of the piston rods 21 and 22, on the front end of the cylinder sleeve 23 and piston rod 22, there are restrict projecting vertexes 231 and 223 coordinating with the restrict slot on the last part of piston rod; after the piston rods 21 and 22 reach their maximum stroke, the restrict projecting vertexes 231 and 223 can restrict piston rods 21 and 22 from moving continuously and breaking away from the cylinder.

On the outer side of the guide rod 10, there is an avoiding bar 14 near the position of the tail of guideway 12; one end of it can be bended to make it convenient for the projecting column 25 to slide into the guiding slot 31.

In addition, Attached Diagrams 12 and 13 show that there is a trimming bar 40 on the base 100 for adjusting the position of the base 100; on both sides of the trimming bar 40, there are screw holes 41 and three guide posts 42 are molded on the inner side of them; correspondingly, there are lead holes 101 coordinating with the guide post 42 on the base 100, the size of lead holes 101 is bigger than that of the guide post 42, the guide post 42 can be moved in the lead hole 101. When installing the buffer, pass the screw through the screw hole on the guide post 42 first; after the whole base 100 is installed on the inner wall of the drawer, the position of the base 100 and trimming bar 40 can be adjusted; after its position is completely put straight, fix the base 100 by screwing up other screws to avoid the installation error caused by inaccurate balance.

Before using this invention, install the base 100 on the outer wall of the drawer, and the plate 30 and the sliding sleeve 200 on the inner wall of it. The following is its principle of work: the Attached Diagrams 6 and 7 show the status when preparing to close the drawer; the base 100 moves towards the drawer cavity along with the drawer and the guide rod 10 on its front end goes into the slide sleeve 200; when the projecting column 25 reaches the position of guiding slot 31 on the front end of the plate 30, the projecting column 25 push open the avoiding bar 14 at the tail of the guideway 12 to slide upward along the guiding slope at the entrance of the guiding slot 31; the Attached Diagram 8 shows that after the projecting column 25 passed the top of the guiding slope, it falls downwards into the notch of the guideway 12 and the avoiding bar 14 sets back at the same time. The Attached Diagrams 9, 10 and 11 show the status when preparing to open the drawer: the base 100 moves outwards with the drawer and when the projecting column 25 reaches the position of the positioning slot 13 on the front end of the guideway 12, the piston rod parts 21 and 22 are stretched to the limiting position. At this time, due to the increased resistance of the spring 24, the projecting column 25 slides along the slope in the guiding slot 31 upwards if the drawer is pulled continuously; when the projecting column 25 rises to the level of the entrance of guiding slot 31, it slides into the positioning slot 13 on the guide rod 10; the limit on the projecting column 25 and guide rod 10 by the plate 30 is relieved and the drawer can be opened smoothly.

The Attached diagrams 14 and 15 show the drawer slide rail works with the drawer buffer: the drawer slide rail includes the outer slide plate 51, intermediate slide plate 52, inner slide plate 53; wherein there are rolling ball races 54 on both the upside and downside of the intermediate slide plate 52; the base 100 of drawer buffer is fixed on the outer side of the outer slide plate 51 and the plate 30 is fixed on the inner slide plate 53; the structure and principle of work is the same as described above and there is no need to repeat them here. This drawer slide rail with drawer buffer provides consumers with more convenient installation and use.

What is claimed is:

1. A drawer buffer comprising:

a base having a guide rod projecting from a front end of the base;

a cylinder fixed in the base and having a piston rod with a projecting column on a front end of the piston rod;

the guide rod having a body with a sliding chute located in a middle of the body for giving a moving space for the piston rod;

the guide rod having a guideway located in a side face of the body to coordinate with the projecting column of the piston rod, a front end of the guideway being connected with a positioning slot; and a plate having a guiding slot for pulling and pushing the projecting column into the positioning slot;

wherein the cylinder and the piston rod have an elliptical cross section, and a tail of the cylinder is linked with a head of the piston rod via a spring.

2. The drawer buffer of claim 1, wherein the piston rod has first and second part-rods along with a cylinder sleeve, a piston ring attached on a tail of each part-rod, the first part-rod is sleeved into the second part-rod while the second part-rod is sleeved into the cylinder sleeve, and a bottom of the cylinder sleeve is linked with a top of the first part-rod by the spring.

3. The drawer buffer of claim 2, wherein each piston ring is made out of plastics and there is a hole in a middle of each piston ring for controlling air speed passed through the rings, thereby creating a buffer.

4. The drawer buffer of claim 2, wherein on a wall of each part-rod, there is a restrict slot, on a front end of the cylinder sleeve and a front end of the second part-rod there is a restrict projecting vertex to coordinate with the restrict slots for preventing the part-rods from being pulled out from the cylinder.

5. The drawer buffer of claim 2, wherein the projecting column is fixed on a moving block and there is a spring under the projecting column, the moving block is hinged with a base fixed on a front end of the first part-rod.

6. The drawer buffer of claim 5, wherein on the side face of the guide rod, there is an avoiding bar near the guideway, one end of the avoiding bar can be bent.

7. The drawer buffer of claim 1, wherein there is a trimming bar on the base for adjusting the position of the base, there are screw holes on both sides of the trimming bar, guide posts are on an inner end face of the trimming bar, there are lead holes on the base to coordinate with the guide posts, the size of the lead holes are bigger than that of the guide posts.

8. The drawer buffer of claim 1, wherein there is a trimming bar on the base for adjusting the position of the base, there are screw holes on both sides of the trimming bar, guide posts are on an inner end face of the trimming bar, there are lead holes on the base to coordinate with the guide posts, the size of the lead holes are bigger than that of the guide posts.

9. The drawer buffer of claim 1, wherein the drawer buffer is used with a drawer slide rail for moving a drawer.

* * * * *